US005168138A

United States Patent [19]

Evans

[11] Patent Number: 5,168,138

[45] Date of Patent: Dec. 1, 1992

[54] MULTI-BALL POSITION SWITCH

[75] Inventor: Doyle R. Evans, Rockwell, Tex.

[73] Assignee: Texas Instruments Incorporated, Dallas, Tex.

[21] Appl. No.: 706,617

[22] Filed: May 29, 1991

[51] Int. Cl.[5] ..... H01H 35/02

[52] U.S. Cl. ..... 200/61.52; 200/61.45 R

[58] Field of Search ..... 200/61.52, 61.45 R, 200/61.51, DIG. 29; 340/429, 440, 689

[56] References Cited

U.S. PATENT DOCUMENTS 2,167,756 8/1939 Hobbs ..... 200/DIG. 29
2,206,094 7/1940 Hobbs ..... 200/DIG. 29
3,198,901 8/1965 Kapadi ..... 200/61.52

FOREIGN PATENT DOCUMENTS 3111099 9/1982 Fed. Rep. of Germany ... 200/61.52

*Primary Examiner*—Harold Broome
*Attorney, Agent, or Firm*—William E. Hiller; Richard L. Donaldson

[57] ABSTRACT

This invention relates in general to the field of position sensing devices. More particularly, the present invention relates to a multi-ball position switch.

24 Claims, 1 Drawing Sheet

MULTI-BALL POSITION SWITCH

BACKGROUND OF THE INVENTION

A position sensing device is a mechanism that is capable of producing a signal in response to being oriented by gravity with respect to the center of the earth. Typical position sensing devices, including reed switches and mercury switches, are undesirable due to problems inherent in their construction. For example, reed switches with sliding magnet actuators provide inaccurate outputs in humid operating conditions. Switches where mercury is used as a sliding conductor are also undesirable because they require the use of mercury, which is a toxic substance. In today's environment conscious atmosphere and mentality, the elimination of mercury switches eases disposal and other problems associated with the handling of toxic substances.

Another position sensing device, disclosed in a pending patent application Ser. No. 07/309,451, filed on Feb. 10, 1989, and titled "Position-Sensitive Educational Product," uses a single conductive ball enclosed within a hollow tube with a metal contact on one end. When the ball rolls to the end of the tube and touches the metal contact due to the orientation of the device with respect to the center of the earth, an electrical signal is produced. Although the structure of the single ball position sensor is relatively simple and economical to manufacture, it is inherently unreliable. The unreliability and inaccuracy of the sensor is grounded in the fact that the electrical signal is produced by the ball touching the metal contact only at one point and touching the tube only at one point. The electrical signal produced is noisy as a result.

In the particular application of children's toys, it is often desirable to determine the position or orientation of the toy so that a correlative auditory or visual response to a child's manipulation of the toy may be appropriately displayed. For example, a doll may emit crying sounds when it is laid down and giggling sounds when it is picked up. A more sophisticated example may consist of an object having multiple surfaces, where a pictorial representation of animals, for example, is depicted on each surface. Whenever the object is set in motion and comes to rest with a surface in the up position, the object may announce the name of the animal and emit an auditory representation of the depicted animal shown on the upwardly facing surface, for example. The multiple surface educational toy is described in detail in aforementioned pending patent application Ser. No. 07/309,451. In the children's toy environment, additional consideration to ensure accurate and safe operation of the toy in view of possible adverse operating conditions, such as shock, vibration and moisture, is especially important.

Therefore, a need has arisen to provide a position sensor that is structurally simple, economical to manufacture and does not involve the use of toxic substances. The desirable position sensor must have the capability to produce a relatively clean electrical signal that is indicative of its orientation with respective to the center of the earth. Furthermore, the desirable position sensor must retain its accuracy in an adverse environment.

SUMMARY OF THE INVENTION

In accordance with the present invention, a multi-ball position sensor is provided which substantially eliminates or reduces disadvantages and problems associated with prior position sensors.

In one aspect of the present invention, position sensing apparatus is provided which comprises a conductive tube having a conductive plate attached to one end of the conductive tube, where the conductive plate substantially encloses that end of the conductive tube, but is electrically isolated therefrom. The conductive tube accommodates a first, second and third sliding conductors which are slidable to rest against the conductive plate in response to the orientation of the conductive tube with respect to the earth's gravitational pull. The dimensions and weights of the sliding conductors are such that they form multiple contacts and enable multiple paths between the conductive tube and the conductive plate.

In another aspect of the present invention, a method for position sensing is provided which comprises the steps of providing a conductive tube and attaching a conductive plate to one end of the conductive tube so that the end is substantially enclosed. The conductive tube is electrically isolated from the conductive plate. At least three sliding conductors are placed within the conductive tube which are free to slide from one end of the tube to the other in response to the orientation of the tube with respect to the earth's gravitational pull. When the sliding conductors come to rest against the conductive plate in response to gravity, multiple conductive paths are formed between the conductive plate and the conductive tube.

An important technical advantage of the present invention provides a position sensor capable of producing a substantially "clean" electrical signal indicative of its relative position with respect to the center of the earth.

BRIEF DESCRIPTION OF THE DRAWINGS

For a better understanding of the present invention, reference may be made to the accompanying drawings, in which.

DETAILED DESCRIPTION OF THE INVENTION

Figure 1:
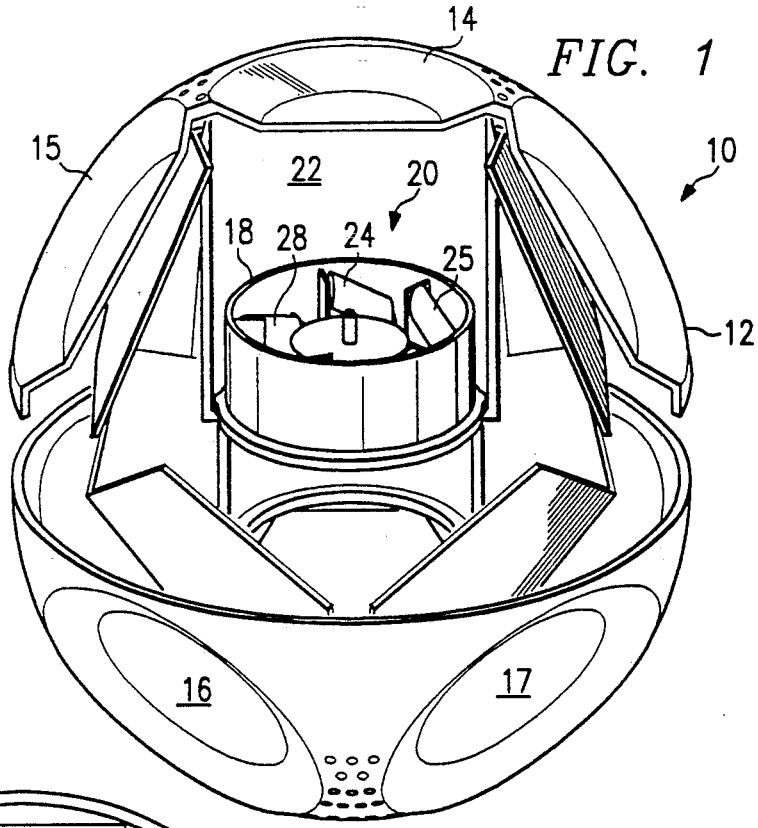
FIG. 1 is an exploded perspective view of a contemplated application of the present invention.
Figure 2:
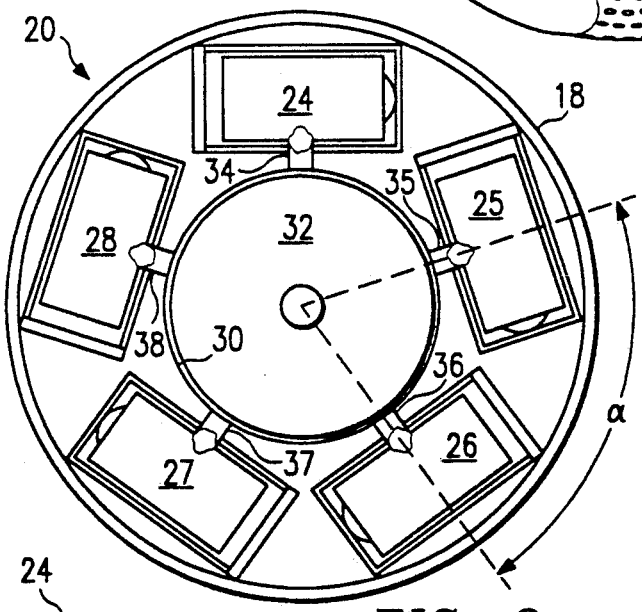
FIG. 2 is a top plan view of an exemplary arrangement of a plurality of position sensors constructed in accordance with the present invention.

With reference to the drawings, FIG. 1 illustrates an exemplary operating environment 10 of a position sensor constructed in accordance with a preferred embodiment of the present invention. FIG. 1 is the simplified outline drawing of an exemplary toy 12 having multiple surfaces, 14–17 for example, upon which it may rest. A cut away reveals an arrangement of position sensors within toy 12. Referring also to FIG. 2 where a top view of the multiple position sensor configuration is shown, position sensors 24–28 are arranged equidistant from one another around a housing 18. Housing 18 encases position sensors 24–28 and is securely fastened to an inner chamber 22 of toy 12. As shown, each position sensor 24–28 is arranged to be perpendicular to one of the planar surfaces 14–17 of toy 12, so that every possible resting position of toy 12 is detectable. In the particular configuration shown in FIGS. 1 and 2, position sensors 24–28 are oriented 72° apart, as indicated by angle $\alpha$ in FIG. 2.

A conductive ring 30 coupled to a predetermined voltage level is arranged around a center axle 32 in housing 18. Conductive ring 30 is further coupled to each position sensor 24–28 via conductive tabs 34–38, respectively. In the present configuration, conductive ring 30 is operative to couple position sensors 24–28 to ground.

Figure 3:
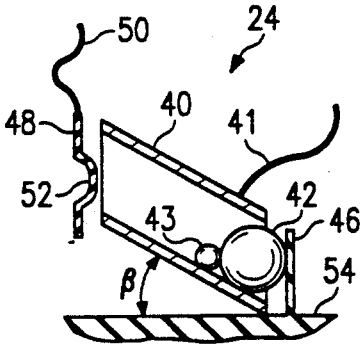

FIGS. 3–6 provide more detailed cut away views of a representative multi-ball position sensor 24, illustrating its operations. Referring to FIG. 3, position sensor 24 comprises a conductive tube 40 which encloses three slidable conductors 42–44. Conductive tube 40 is preferably constructed of brass with copper and nickel plating. A conductive wire 41 is electrically coupled to tube 40. In the preferred embodiment, slidable conductors 42–44 are metallic spheres constructed of stainless steel, where ball 42 is substantially larger than balls 43 and 44, and balls 43 and 44 are preferably of equal size. In the preferred embodiment of the present invention, the diameter of tube 40 is approximately 10.2 millimeters, the diameter of ball 42 is approximately 9.5 millimeters, and the diameters of balls 43–44 are approximately 4.75 millimeters. Additionally, balls 42–44 are of similar construction and material so that ball 42, which is substantially larger, is substantially heavier than balls 43 and 44. One weight specification that has been shown to function well indicates ball 42 should be approximately 3.6 grams and balls 43–44 should be approximately 0.45 grams each. As shown by FIG. 3, ball 44 is hidden behind ball 43.

Position sensor 24 further comprises an end plate 46 at one end of tube 40, which substantially closes the end of tube 40 and prevents balls 42–44 from exiting tube 40. At the other end of tube 40 is a second end plate 48 substantially closing the other end of tube 40. Second end plate 48 is electrically coupled to a conductive wire 50, but electrically isolated from tube 40. In the preferred embodiment of the present invention, end plate 48 includes a protruding feature 52, which projects toward tube 40. End plate 48 is preferably made from phosphor bronze with nickel plating. Additionally, it is preferable that an electrical lubricating oil is used to coat the inner surface of tube 40 and outer surfaces of balls 42–44 to ensure optimal operations. FLOIL manufactured by Kanto Chemicals Company of Japan is preferred for this purpose.

FIG. 3 shows position sensor 24 at one phase of its operation when the surface 54 on which it sits is level. Because position sensor 24 is positioned at an incline having $\beta$ degrees above the horizontal, when surface 54 is substantially level with respect to the center of the earth, balls 42–44 are pulled by gravity toward one end of tube 40 and come to rest against one another and against end plate 46. In the application shown in FIGS. 1 and 2, the angle $\beta$ is equal to 27°. At this phase of its operation, there is no electrically conductive path from wire 50 to wire 41.

Figure 4:
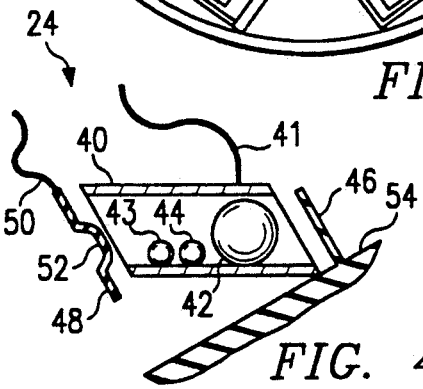

Referring to FIG. 4, surface 54 is tilted to a point where tube 40 is level with respect to the center of the earth. Due to the pull of gravity and the inner surface of tube 40 on which they sit, balls 42–44 become separated from one another and are arranged along a center line of tube 40. In this configuration, there is also not an electrical path from wire 50 to wire 41.

Figure 6:
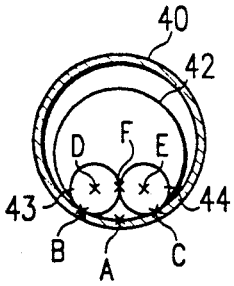
FIGS. 3–6 are side views of a preferred embodiment of the present invention, where each figure illustrates a phase in the operations of the present invention.
Figure 5:
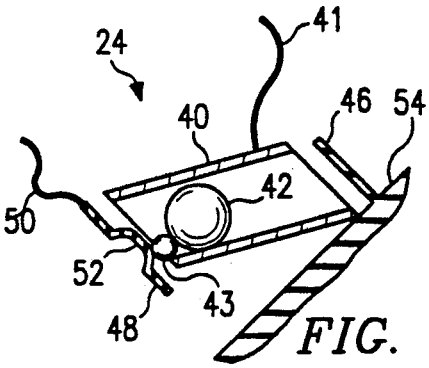

Referring to FIG. 5, surface 54 is positioned at an incline that also tilts tube 40 past the horizontal. Balls 42–44 are pulled by the gravity and come to rest against protrusion 52 of end plate 48. More specifically, balls 43 and 44 come to rest side by side against protrusion 52 and ball 42 comes to rest against balls 43 and 44 and effectively forces them against protrusion 52. In the view illustrated in FIG. 5, ball 44 is hidden behind 43. FIG. 6 and TABLE A below illustrate the multiple contact points which enable an electrical path to be formed between wire 50 and wire 41.

TABLE A

| Contact Point | Description |
|---|---|
| A | ball 42 to tube 40 |
| B | ball 43 to tube 40 |
| C | ball 44 to tube 40 |
| D | ball 43 to protrusion 52 |
| E | ball 44 to protrusion 52 |
| F | ball 43 to ball 44 |
| G (not shown) | ball 42 to ball 43 |
| H (not shown) | ball 42 to ball 44 |

In operation, as position sensor 24 is tilted from end to end, depending on the angle of tube 40 with respect to true horizontal, an electrical path is formed between wire 41 and 50. In the preferred embodiment of the present invention, wire 41 is coupled to a known potential, such as ground, and wire 50 is coupled to a circuit or microprocessor. The circuitry or microprocessor is adapted to detect when the voltage level on wire 50 is tied to ground through the path formed by balls 42–44 coming to rest against end plate 48. Because of the multiple contacts, eight in the preferred embodiment, electrical noise in the electrical signal is substantially reduced. A more constant and low impedance path is formed between circuitry coupled to wire 50 and ground than if a single sliding conductor is used. The significant reduction in electrical noise and other qualities associated with the present invention provide a more accurate position sensing device.

Note that position sensors 24–28 may be arranged in a number of configurations appropriate to the application at hand and is not limited to that shown in FIGS. 1 and 2. Furthermore, the angle $\beta$ at which tube 40 is positioned with respect to the horizontal is variable and is dependent on the particular application in which multi-ball position sensor 24 is used. It is also contemplated by the present invention to employ sliding conductors not spherical in shape, but which function in the same manner as described herein.

Although the present invention has been described in detail, it should be understood that various changes, substitutions and alterations can be made thereto without departing from the spirit and scope of the present invention as defined by the appended claims.

What is claimed is:

1. Position sensing apparatus, comprising:

a conductive tube having a first and second end;

a conductive plate attached to said second end of said conductive tube and substantially enclosing said second end of said conductive tube, said conductive plate being electrically isolated from said conductive tube;

a first sliding conductor being accommodated within said conductive tube and slidable from one end of said conductive tube to the other in response to the orientation of said conductive tube with respect to the earth's gravitational pull;

a second sliding conductor being accommodated within said conductive tube and slidable from said first end of said conductive tube to said second end and adapted to contact both said first sliding conductor and said conductive plate simultaneously, while remaining in contact with said conductive tube, in response to the orientation of said tube with respect to the earth's gravitational pull; and a third sliding conductor being accommodated within said conductive tube and slidable from one end of said tube to the other and adapted to contact said first and second sliding conductors and said conductive plate simultaneously, while remaining in contact with said conductive tube, in response to the orientation of said conductive tube with respect to the earth's gravitational pull.

2. The apparatus, as set forth in claim 1, further comprising a protrusion formed on said conductive plate projecting toward said conductive tube.

3. The apparatus, as set forth in claim 1, wherein said first, second and third sliding conductors are spherical so that said spherical conductors are adapted to roll from one end of said conductive tube to the other.

4. The apparatus, as set forth in claim 1, wherein said first, second and third sliding conductors are quantifiable by a dimension, and said dimension of said first sliding conductor is substantially larger than that of said second and third sliding conductors.

5. The apparatus, as set forth in claim 4, wherein said dimension is a measurement of length.

6. The apparatus, as set forth in claim 4, wherein said dimension is a measurement of weight.

7. The apparatus, as set forth in claim 1, wherein said second and third sliding conductors are quantifiable by a dimension, and said dimension of said second sliding conductor is substantially equal to that of said third sliding conductor.

8. The apparatus, as set forth in claim 7, wherein said dimension is a measurement of length.

9. The apparatus, as set forth in claim 7, wherein said dimension is a measurement of weight.

10. The apparatus, as set forth in claim 1, wherein said conductive tube is coupled to a known potential and said conductive plate is coupled to a circuitry adapted to detect when said first, second and third sliding conductors contacting one another simultaneously while contacting said conductive tube, and said second and third sliding conductors further contacting said conductive plate simultaneously, thereby an electrical path is formed from said conductive plate through said first, second and third sliding conductors and to said conductive tube.

11. The apparatus, as set forth in claim 7, wherein said conductive plate is coupled to a known potential and said conductive tube is coupled to a circuitry adapted to detect when said first, second and third sliding conductors contacting one another simultaneously while contacting said conductive tube, and said second and third sliding conductors further contacting said conductive plate simultaneously, thereby an electrical path is formed from said conductive plate through said first, second and third sliding conductors and to said conductive tube.

12. A method for position sensing, comprising the steps of:

providing a conductive tube having a first and second end;

attaching a conductive plate to said second end of said conductive tube and substantially enclosing said second end of said conductive tube, but isolating said conductive plate electrically from said conductive tube;

positioning a first sliding conductor within said conductive tube and allowing it to slide from one end of said tube to the other in response to the orientation of said tube with respect to the earth's gravitational pull;

positioning a second sliding conductor within said conductive tube and allowing it to slide from said first end of said conductive tube to said second end and further allowing it to contact both said first sliding conductor and said conductive plate simultaneously, while remaining in contact with said conductive tube, in response to the orientation of said tube with respect to the earth's gravitational pull; and positioning a third sliding conductor within said conductive tube and allowing it to slide from one end of said tube to the other and further allowing it to contact said first and second sliding conductors and said conductive plate simultaneously, while remaining in contact with said conductive tube, in response to the orientation of said conductive tube with respect to the earth's gravitational pull.

13. The method, as set forth in claim 12, further comprising the step of forming a protrusion on said conductive plate projecting toward said conductive tube.

14. The method, as set forth in claim 12, wherein said first, second and third sliding conductors positioning steps include positioning spherical first, second and third conductors so that said spherical conductors are adapted to roll from one end of said conductive tube to the other.

15. The method, as set forth in claim 12, wherein said first, second and third sliding conductors positioning step include positioning said sliding conductors where the dimension of said first sliding conductor is substantially larger than that of said second and third sliding conductors.

16. The method, as set forth in claim 15, wherein said first, second and third sliding conductor positioning steps include positioning a substantially larger first sliding conductor than said second and third sliding conductors.

17. The method, as set forth in claim 15, wherein said first, second and third sliding conductor positioning steps include positioning a substantially heavier first sliding conductor than said second and third sliding conductors.

18. The method, as set forth in claim 12, wherein said second and third sliding conductor positioning steps include positioning two substantially equal dimensioned second and third sliding conductors.

19. The method, as set forth in claim 18, wherein said second and third sliding conductor positioning steps include positioning two substantially equal-sized second and third sliding conductors.

20. The method, as set forth in claim 18, wherein said second and third sliding conductor positioning steps include positioning two substantially equal-weight second and third sliding conductors.

21. The method, as set forth in claim 12, further comprising the steps of:

coupling said conductive tube to a known potential; and coupling said conductive plate to a circuitry adapted to detect when said first, second and third sliding conductors are contacting one another simultaneously while contacting said conductive tube, and said second and third sliding conductors further contacting said conductive plate simultaneously, thereby forming an electrical path from said conductive plate through said first, second and third sliding conductors and to said conductive tube.

22. The method, as set forth in claim 12, further comprising the steps of:

coupling said conductive plate to a known potential; and coupling said conductive tube to a circuitry adapted to detect when said first, second and third sliding conductors are contacting one another simultaneously while contacting said conductive tube, and said second and third sliding conductors further contacting said conductive plate simultaneously, thereby forming an electrical path from said conductive plate through said first, second and third sliding conductors and to said conductive tube.

23. A gravity-sensitive structure capable of generating an output based upon gravitational orientation, said gravity-sensitive structure comprising:

a housing having a plurality of substantially flat regions at least partially defining the outer surface thereof and adapted to be placed in a plurality of gravitational orientations respectively corresponding to each of the substantially flat regions being disposed upon a horizontal support surface;

an electrical circuit having a first terminal and a second terminal spaced from each other to provide an interruption in the electrical circuit, said electrical circuit including structure for generating a signal when said first terminal and said second terminal are electrically connected; and a position-sensing mechanism disposed within said housing and including a plurality of position-sensing devices disposed in angular relationship with respect to each other;

each of said plurality of position-sensing devices comprising a conductive tube connected to said first terminal of said electrical circuit and having a first and a second end, a conductive plate attached to said second end of said conductive tube and substantially enclosing said second end of said conductive tube, said conductive plate being electrically isolated from said conductive tube and being connected to said second terminal of said electrical circuit, a first sliding conductor disposed within said conductive tube and slidable from one end of said conductive tube to the other end in response to the placement of said housing providing an orientation of said conductive tube with respect to gravity, a second sliding conductor disposed within said conductive tube and slidable from said first end of said conductive tube to said second end and adapted to contact both said first sliding conductor and said conductive plate simultaneously, while remaining in contact with said conductive tube, in response to the placement of said housing providing an orientation of said conductive tube with respect to gravity, and a third sliding conductor disposed within said conductive tube and slidable from one end of said tube to the other end and adapted to contact said first and second sliding conductors and said conductive plate simultaneously, while remaining in contact with said conductive tube, in response to the placement of said housing providing an orientation of said conductive tube with respect to gravity; and said position sensing mechanism being responsive to the placement of said housing with any one of said plurality of substantially flat regions in engagement with the support surface to enable at least one of said plurality of position-sensing devices to connect said first and second terminals of said electrical circuit via said conductive tube, said sliding conductors and said conductive plate of said at least one position-sensing device.

24. A gravity-sensitive structure as set forth in claim 23, wherein said plurality of position-sensing devices are disposed in equiangular relationship with respect to each other.

* * * * *